United States Patent [19]

Roucau et al.

[11] 4,333,273

[45] Jun. 8, 1982

[54] ELECTRIC KNIFE SHARPENER

[76] Inventors: Gilles Roucau, 11667 St-Julien, Montreal-North, Prov. of Quebec, Canada, H1H 3Y9; Emilien Roussy, 2259 Désormeaux, St., Montreal, Prov. of Quebec, Canada, H1L 4X2

[21] Appl. No.: 152,701

[22] Filed: May 23, 1980

[51] Int. Cl.[3] ..... B24B 3/54

[52] U.S. Cl. ..... 51/102; 51/128

[58] Field of Search ..... 51/102, 128, 134.5 R

[56] References Cited

U.S. PATENT DOCUMENTS

| | | | |
|---|---|---|---|
| 2,114,106 | 4/1938 | Geueke | 51/102 |
| 2,257,407 | 9/1941 | Wulff | 51/102 |
| 2,522,942 | 9/1950 | Gillen | 51/128 |
| 2,722,783 | 11/1955 | O'Russa | 51/128 UX |
| 2,799,125 | 7/1957 | Dicke | 51/102 X |
| 3,075,322 | 1/1963 | Uthoff | 51/128 |
| 3,911,625 | 10/1975 | Ise | 51/128 |

*Primary Examiner*—Harold D. Whitehead

[57] ABSTRACT

An electric knife sharpener characterized by an electric motor having a stator winding producing a magnetic axial bias on the armature and on a grinding wheel axially displaceable bodily with the armature and by a pair of slots adapted to engage a knife against them and angularly intersecting the grinding wheel whereby a properly inserted blade axially displaces the grinding wheel and the motor armature to achieve a substantially constant magnetic axial bias of the grinding wheel against the blade of a knife upon magnetic action of the motor winding on the motor armature.

5 Claims, 6 Drawing Figures

ELECTRIC KNIFE SHARPENER

FIELD OF THE INVENTION

This invention relates to a knife sharpener and more particularly, to a knife sharpener of the type having a grinding wheel driven by an electric motor, as commonly used in homes.

BACKGROUND OF THE INVENTION

In the electric knife sharpeners of the type that have been proposed so far, the slot or slots for the knife, and the grinding wheel are relatively arranged with the result that the quality of the sharpening very much depends on the skill of the user. In practice, this leads to uneven sharpening, faster grinding out of the knives to correct unevenly grounded spots or portions of the blade, and to a skill requirement that is beyond the possibilities of many people. More particularly, the electric knife sharpeners that have been proposed so far include at least one of the following disadvantages: their slots are arranged such that the knife is not positively guided all the way at the same angle relative to the grinding face; the pressure of the blade against the grinding wheel is not positively controlled and is entirely dependent on the skill of the user; the same slot is used for the left side and the right side of the blade and there is thus a problem to hold the blade at the same angle for both sides; the grinding wheel rotates in the front to rear direction against the blade and this produces a rough cutting edge with grainings on it.

SUMMARY OF THE INVENTION

A general object of the present invention is to provide an electric knife sharpener of the above type that is constructed and arranged to substantially avoid the above mentioned disadvantages.

A more particular general object of the present invention is to provide an electric knife sharpener of the above type that is adapted to provide even sharpening of knives substantially irrespective of the skill of the user.

A more specific object of the present invention is to provide an electric knife sharpener of the above type that produces even biasing of a knife and grinding wheel operatively against each other.

Another object of the present invention is to provide an electric knife sharpener of the above type wherein the knife is adapted to be positively held angularly and positionally relative to a grinding wheel for even grinding all the way along the blade of the knife.

A further object of the present invention is to provide an electric knife sharpener of the above type wherein there is a slot on each side of the grinding wheel to separately and accurately grind both sides of a knife in those slots respectively.

A still further object of the present invention is to provide an electric knife sharpener of the above type wherein the motor and the slots are arranged to rotate the grinding wheel against the blade of a knife in the forward direction of displacement of the knife and thereby produce a minimum of grainings on the blade.

Still another object of the present invention is to provide an electric knife sharpener of the above type wherein the bias of the grinding wheel relative to the blade of a knife is achieved by magnetic axial bias of the grinding wheel by the magnetic field of the motor winding.

BRIEF DESCRIPTION OF THE DRAWINGS

The above and other objects and advantages of the present invention will be better understood with reference to the following detailed description of a preferred embodiment thereof which is illustrated by way of example in the accompanying drawings, in which.

The illustrated electric knife sharpener comprises a housing formed of an upper portion 1 and a bottom or lower portion 2. An electric switch is secured to the upper portion 1 and outwardly projects therefrom to energize an electric motor during a grinding wheel 4. The electric motor 5 is secured to the base portion 2 and projects into the upper housing portion 1.

Figure 4:
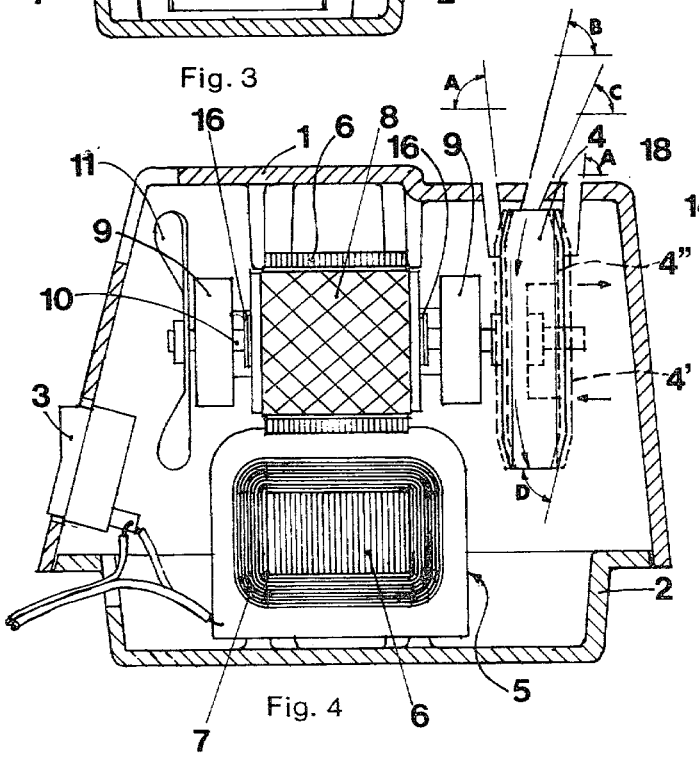
FIG. 4 is a cross-sectional view as seen along line 4—4 in FIG. 1.

The electric motor 5 includes a stator and a rotor. The stator comprises a fixed armature 6 made of laminations, as shown in FIG. 4, with a winding 7 coiled around a bottom portion of the fixed armature. The rotor of the motor comprises an armature 8 rotatively mounted as is well known for magnetic energization by the winding 7 through the laminated armature 6. A pair of bearings 9 rotatively carry a shaft 10 on which are fixedly secured the armature 8 and the grinding wheel 4 for bodily displacement therewith both in rotation and axially relative to the bearings 9. A ventilating fan 11 is secured on the opposite end of the shaft 10 to ventilate the motor upon its rotation. The bearings 9 and the mounting of the shaft 10 is such that the latter is freely axially displaceable. It is well known that the magnetic field provided by the winding 7 produces a magnetic bias on the armature 8 to drive the latter. Also, it is known but to a less extent that the same magnetic field produces an axial bias against axial displacement of the rotary armature 8 either way from a neutral, intermediate axial position.

Figure 6:
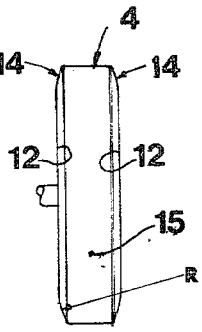
FIG. 6 is a view of a grinding wheel forming part of the electric knife sharpener of the other figures of drawings.

The grinding wheel 4 defines axially opposite flat faces or sides 12 each having a circumferential outer edge or line 13 and a circumferential outer portion adjoining the line 13. On each side of the grinding wheel 4, there is also provided a circumferential outer portion 14 which, as shown in FIG. 6, is transversely convex with a radius indicated by R to sharpen a hollow ground blade. The grinding wheel 4 also includes a cylindrical surface 15. Washers 16 are mounted on the shaft 10 to separate the rotary armature 8 from the bearings 9.

Figure 1:
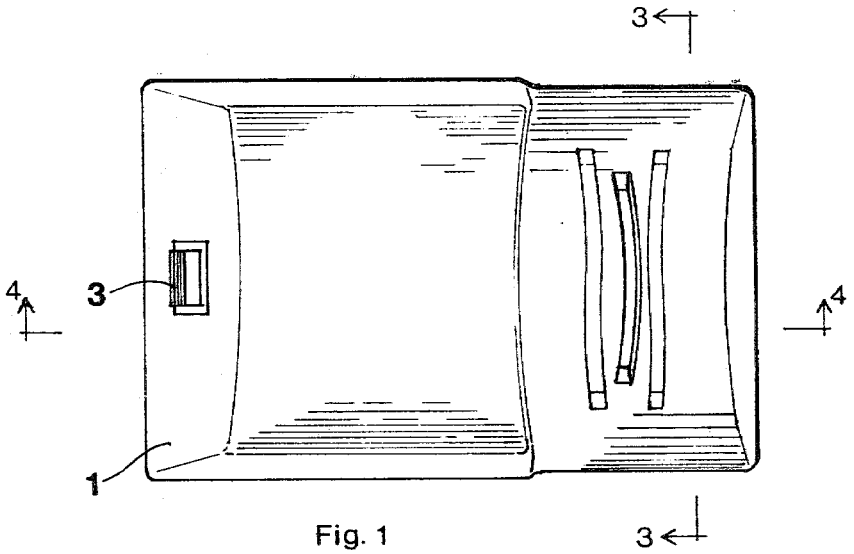
FIG. 1 is a top plan view of an electric knife sharpener according to the present invention.
Figure 2:
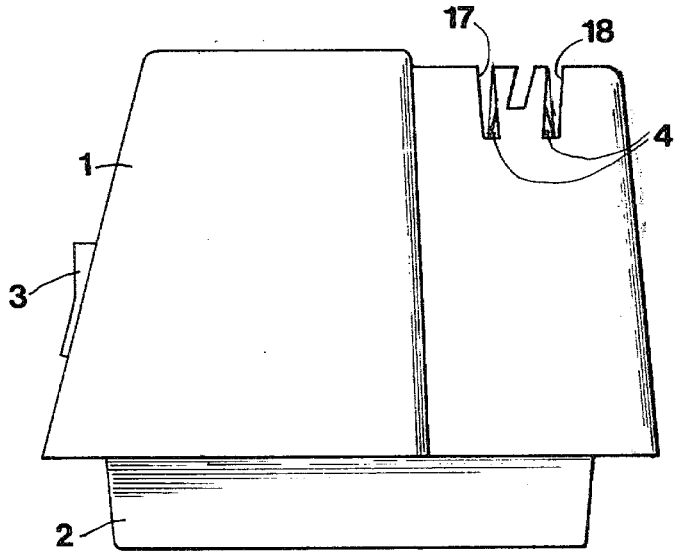
FIG. 2 is a front elevation view of the same electric knife sharpener.

The upper portion 1 of the housing is provided with a pair of slots 17 and 18 extending downwardly into the upper portion, each to a predetermined depth and at a predetermined angle. The slots 17 and 18 are arranged on the opposite sides of the grinding wheel with their plane converging toward each other and toward the grinding wheel such that each of these slots intersects the corresponding side of the grinding wheel when the latter stands in the neutral position of magnetic axial bias produced by the winding 7 on the rotor armature 8. This relationship between the slots 17 and 18 and the grinding wheel 4 is illustrated in FIGS. 2 and 4 wherein the full line illustration of the grinding wheel represents its neutral position of magnetic axial bias. The depth of the slots 17 and 18 is such that the blade B of a knife K is engaged to the bottom thereof, the blade will overlap the above mentioned flat circumferential outer portion only with a small overlap indicated by the letter E in FIG. 3. The letter F indicates the depth of the ground portion that can be made by the circumferential surfaces 14 of the grinding wheel 4.

It must be readily understood that upon operative engagement of the blade B of a knife K in the slot 17, the grinding wheel 4 is axially displaced a predetermined distance by the blade to the position indicated by the dashed lines 4' in FIG. 4. There results the same axial displacement of the armature 8 resulting in the magnetic field acting thereon to produce a counter-acting magnetic axial bias of the grinding wheel 4 against the right side of the blade. Similarly, the engagement of the blade of a knife to the bottom of the slot 18 produces a magnetic axial bias in the opposite direction upon displacement of the grinding wheel to the dashed lines position 4''. Thus, a constant magnetic axial bias is produced against either side of the blade. The right side and the left side of the blade are sharpened into the left and the right slots respectively. The slots 17 and 18 are inclined at a predetermined angle A, as shown in FIG. 4, for optimum sharpening of the cutting edge of knife blades.

An intermediate slot 19 is formed in the top of the housing portion 1 in overlying registry with the cylindrical surface 15 of the grinding wheel 4. The slot 19 is in an inclined plane relative to the plane of rotation of the grinding wheel and has opposite faces inclined at different angles B and C, shown in FIG. 4. The differently inclined opposite faces are predetermined to engage the two blades respectively of scissors against them.

Figure 3:
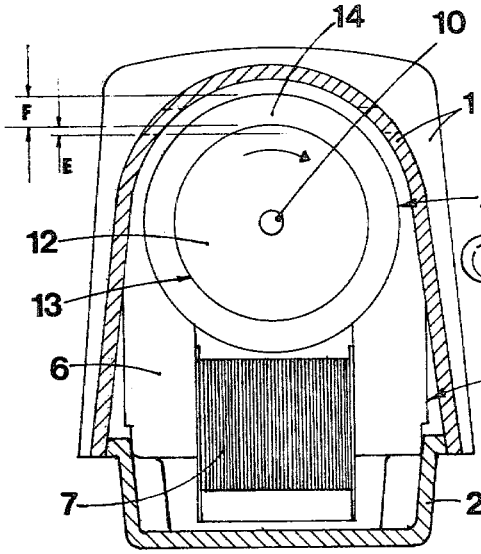
FIG. 3 is a cross-sectional view, as seen along line 3—3 in FIG. 1.
Figure 5:
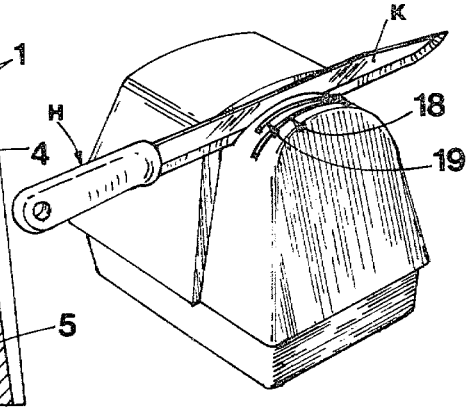
FIG. 5 is a perspective view of the same electric knife sharpener with a knife operatively associated with it in sharpening position.

As shown in FIG. 3, the grinding wheel 4 has its upper portion rotating in a forward direction against the blade of the knife to produce a very smooth sharpening free of grainings along the edge of the blade.

What we claim is:

1. An electric knife sharpener comprising a housing, an electric motor mounted in said housing and including a rotor and a stator, bearing means rotatively holding the rotor and arranged for axial displacement of the latter, said rotor having an armature rotatively carried by said bearing means and axially displaceable relative thereto, the stator having a winding producing a magnetic field operatively acting on the armature to drive the rotor and axially biasing the armature against axial displacement thereof from a magnetically neutral axial position relative to said bearing means, a grinding wheel connected to the rotor and axially displaceable bodily therewith against the magnetic axial bias produced on the rotor by the winding, and said housing havinhg at least one aperture therein adjacent the grinding wheel and providing access to hold a knife in lateral contact with one side of the grinding wheel against said magnetic axial bias for operative sharpening of the knife.

2. An electric knife sharpener as defined in claim 1, wherein said one aperture constitutes one slot extending into the housing in a plane converging with the plane of rotation of the grinding wheel and intercepting the latter at a predetermined axial distance while the armature stands in said magnetically neutral axial position whereby, upon engagement of a knife at the bottom of said one slot, the grinding wheel axially engages against the knife with a constant magnetic axial bias.

3. An electric knife sharpener as defined in claim 2, wherein said housing includes another slot extending therein, both of said slots extend in converging planes relative to each other and to the plane of rotation of the grinding wheel and on the axially opposite sides of the latter, each of said slots intersects the grinding wheel a predetermined axial distance while the armature stands in said magnetically neutral axial position, each of said slots defines a front end and a rear end corresponding to a front and a rear of the housing respectively, and said motor is constructed and arranged to rotate the grinding wheel in a forward direction adjacent said slots and against the blade of a knife.

4. An electric knife sharpener as defined in claim 3, wherein the grinding wheel has opposite sides defining flat faces at right angle to the rotation axis of the grinding wheel and a bevel annular surface adjoining said flat faces circumferentially outward thereof and said flat faces have each a radially outmost circumferential portion axially registering with the bottom of the corresponding slot whereby a knife in one of the slots is sharpened against and by the corresponding outmost circumferential portion.

5. An electric knife sharpener as defined in claim 4, wherein said housing includes a third slot extending therethrough in an inclined plane intermediate said one and said another slots and said grinding wheel includes a flat circumferental surface underlying said third slot and forming an angle relative thereto adapted to sharpen scissors into the third slot against the flat circumferential surface.

* * * * *